US005901777A

United States Patent [19]

Matsumura et al.

[11] Patent Number: 5,901,777

[45] Date of Patent: May 11, 1999

[54] TWIN-ROLL CONTINUOUS CASTING METHOD

[75] Inventors: Yoshikazu Matsumura, Kitakyushu; Yoshio Morimoto, Tokyo; Kiyomi Shio, Futtsu; Yoshiyuki Ueshima, Futtsu; Toshiaki Mizoguchi, Futtsu; Satoshi Akamatsu, Futtsu; Shigeru Ogawa, Futtsu; Kazuo Koyama, Futtsu, all of Japan

[73] Assignee: Nippon Steel Corporation, Tokyo, Japan

[21] Appl. No.: 08/553,707

[22] PCT Filed: Apr. 3, 1995

[86] PCT No.: PCT/JP95/00643

§ 371 Date: Jan. 16, 1996

§ 102(e) Date: Jan. 16, 1996

[87] PCT Pub. No.: WO95/26840

PCT Pub. Date: Oct. 12, 1995

[30] Foreign Application Priority Data

Apr. 4, 1994 [JP] Japan ..... 6-087232
Apr. 6, 1994 [JP] Japan ..... 6-068813

[51] Int. Cl.[6] ..... B22D 11/06; B21B 1/46

[52] U.S. Cl. ..... 164/475; 164/476; 164/477; 164/480

[58] Field of Search ..... 164/475, 476, 164/480, 415, 417, 428, 477

[56] References Cited

U.S. PATENT DOCUMENTS

Re. 21,261 11/1939 Hazelett ..... 164/417 X
5,584,337 12/1996 Nakashima et al. ..... 164/476 X

FOREIGN PATENT DOCUMENTS 0326190 8/1989 European Pat. Off. .
0344095 11/1989 European Pat. Off. .
0371281 6/1990 European Pat. Off. .
58-359 1/1983 Japan .
60-83745 5/1985 Japan .
62-9752 1/1987 Japan ..... 164/476
62-9753 1/1987 Japan ..... 164/417
62-50008 3/1987 Japan .
63-115654 5/1988 Japan .
63-76308 5/1988 Japan .
64-5742 1/1989 Japan .
2-247049 10/1990 Japan .
3-294419 12/1991 Japan .
4-200801 7/1992 Japan .
WO89/11363 11/1989 WIPO .
WO 95/13155 5/1995 WIPO .

OTHER PUBLICATIONS

Patent Abstracts of Japan, vol. 012, No. 236 (M–715), Jul. 6, 1988 & JP 63–030158 A (Nippon Kokan KK), Feb. 8, 1988.

Patent Abstracts of Japan, vol. 009, No. 226 (M412), Sep. 12, 1985 & JP 60–083745 A (Mitsubishi Jukogyo KK), May 13, 1985.

Patent Abstracts of Japan, vol. 7, No. 283 (M–283) [1428], Dec. 16, 1983 & JP–58 159947 A (Ishikawajima Harima Jukogyo KK), Sep. 22, 1983.

*Primary Examiner*—J. Reed Batten, Jr.
*Attorney, Agent, or Firm*—Kenyon & Kenyon

[57] ABSTRACT

A casting C obtained by solidification of molten metal by using a pair of water cooled casting rolls 2*a*, 2*b* is subjected to temperature adjustment in a temperature zone so that an austenite structure exists in its matrix. Thereafter, the casting is rolled by an in-line rolling mill 5 at a temperature ranging from 850° C. to less than 1,350° C. and at a reduction of 5 to 50%. In this way, overall variance of elongation of the steel material is kept within 5% in terms of the standard deviation.

7 Claims, 7 Drawing Sheets

TWIN-ROLL CONTINUOUS CASTING METHOD

TECHNICAL FIELD

This invention relates to a twin-roll continuous casting method and apparatus for conducting in-line rolling of a thin sheet casting during its transfer, and more particularly to an improved twin-roll continuous casting method which improves the rolling conditions in in-line rolling and a twin-roll continuous casting machine used for this method.

This invention relates to a production method of an ordinary steel sheet corresponding to a hot-rolled steel sheet by using a cast strip produced by the present method as a starting material, and more particularly to a method of reducing variance of materials typified by elongation of the steel material.

BACKGROUND ART

Generally, a twin-roll continuous casting machine is known as an apparatus applying a Bessemer type continuous casting method, and is used for producing a metal thin sheet by pouring a molten metal between a pair of water-cooled casting rolls and solidifying it.

The production of the thin sheet by a twin-roll continuous casting machine 11 of this kind is carried out as shown in FIG. 3. A molten metal L is poured from above and between a pair of casting rolls 12*a* and 12*b* disposed with a predetermined gap between them as shown in the drawing, and these casting rolls cooled inside with water 12*a*, 12*b* are rotated inwardly downward. Then, the molten metal L are brought into contact with the casting rolls 12*a*, 12*b* and is cooled, and is solidified as the solidified shell S in an arcuate form on the surface of each casting roll 12*a*, 12*b*. Each solidified shell S is brought close to the other with the revolution of the casting rolls 12*a*, 12*b* and is pressed at the minimum portion of the roll gap (hereinafter referred to as the "roll kiss point") into a casting C having a predetermined thickness. The casting C is pulled down from between the casting rolls 12*a*, 12*b*.

In this case, it is the point F (hereinafter referred to as the "solidification start point") at which the molten metal L comes into contact with each casting roll 12*a*, 12*b* that solidification of the solidified shell S starts. Each solidified shell S which starts solidifying from the solidification start point F of each casting roll 12*a*, 12*b* continues to grow till the roll kiss point, and at this roll kiss point, each solidified shell S is rolled into the casting C having a predetermined thickness.

An associated technology for winding the casting C so produced onto a coiler as-cast and shipping the product is described in Japanese Unexamined Patent Publication (Kokai) No. 58-359.

The gist of the invention disclosed in this prior art resides in the following point. In the method, a runner box encompassed by a frame is defined between a pair of water cooling rolls and a tundish, and the upper surface of a molten steel runner box frame is brought into close contact with the bottom surface of said tundish so that an iron hydrostatic pressure of the molten steel level inside said tundish is allowed to act on the solidified shells formed on the pair of said water cooling rolls.

Because this process can obtain a thin cast strip having a casting thickness equivalent to that of a hot-rolled steel sheet obtained through existing rough rolling and finish rolling, at the time of casting, the process can eliminate the hot rolling step according to the prior art and can drastically reduce the cost of production. However, the steel sheet in the form of the cast strip as it is involves the problem that it is inferior in the aspect of the material.

In other words, according to the invention of the prior art, the casting so produced is used, in the as-cast state, as the product. Therefore, the crystal grain size is great, and both elongation and machinability are low. In other words, satisfactory mechanical strength cannot be obtained. Further, because scales of about 100 $\mu$m adhere to the surface of the thin sheet casting as-cast, the surface of the casting is rough and coarse.

Therefore, in order to finish the casting C so casted to the product, there are a method which removes the scales of the casting C after casting, rolls it into a predetermined sheet thickness by hot rolling and winds the resulting strip on a coiler, and another which removes the scales of the casting C after casting, rolls it into a predetermined sheet thickness by cold rolling, anneals the resulting strip and winds it up on the coiler to obtain the product.

A method of finely refining the crystal grain size is described in Japanese Unexamined Patent Publication (Kokai) No. 63-115654.

The gist of the invention disclosed in this prior art resides in the following point. In the method, heat-treatment of cooling a metal thin sheet so casted to a temperature below an $A_1$ transformation point and then heating it again to a temperature above an $A_3$ transformation point or heating and holding it at said $A_3$ transformation point and again cooling it to a temperature below the $A_1$ transformation point is repeated at least twice in an in-line state.

Japanese Unexamined Patent Publication (Kokai) No. 60-83745 discloses a method of making the texture fine by imparting several times hot-rolling to the casting at a total reduction of at least 20%.

These means all intend to improve the materials by making the metallic texture fine by utilizing recrystallization or transformation. As to factors other than such a metallic structure, the reasons why the materials of the steel sheet in the form of the thin cast strip are inferior have not been sufficiently clarified. When the materials of the thin cast strip are discussed, no prior art references inclusive of the references described above have ever made mention of fluctuation of the materials, that is, variance.

In the invention disclosed in the prior art of JP 63-115654, the crystal grain size is converted to a fine grain size by conducting cooling to the ferrite ($\alpha$) zone immediately after solidification and heating to the austenite ($\gamma$) zone. However, there remains the problem that the cost of equipment increases because the entire length of the metal thin sheet casting machine used is elongated.

By the way, in order to obtain a product from the casting C by in-line rolling, hot rolling is used more preferably than cold rolling so as to prevent the increase of the entire length of the machine.

Generally, in a case of an inferior material, one is inferior in the characteristics itself and the other is inferior in the fluctuation of the characteristics. In the latter case, though the fluctuation of the material is a predominant problem in a discussion of the steel material since the lowest limit value of the property of the material should be adopted due to product liability as the property of the material, the thin cast strip produced by the process has not sufficiently be studied in view of the point.

DISCLOSURE OF INVENTION

The object of the present invention is to provide a method for reducing the fluctuation of the material in a common steel sheet equivalent to a hot rolled steel sheet produced from the thin cast strip as a starting material, which is thought to be inferior in the characteristics of the material compared with the present hot rolled steel sheet.

In view of the problem described above, it is an object of the present invention to provide a twin-roll continuous casting method and an apparatus therefor, which can produce a thin sheet having excellent mechanical strength by reducing homogeneously the crystal grain size to a fine grain size by in-line hot rolling and having excellent surface roughness free from skin roughness, and which can reduce the cost of equipment.

The gist of the present invention is as follows.

(1) A twin-roll continuous casting method including the steps of pouring a molten metal of an ordinary carbon steel having a carbon content of 0.0005 to 1 wt % between a pair of water cooling casting rolls, and rolling the resulting casting after solidification into a predetermined sheet thickness by an in-line rolling mill, characterized in that the resulting casting after solidification is rolled by one pass by said in-line rolling mill to a reduction of 5 to 50%, is thereafter transferred, and is then taken up into a coil form by a coiler.

(2) A twin-roll continuous casting method including the steps of pouring a molten metal of an ordinary carbon steel having a carbon content of 0.0005 to 1 wt % between a pair of water cooling casting rolls, and rolling the resulting casting after solidification into a predetermined sheet thickness by an in-line rolling mill, characterized in that the resulting casting after solidification is transferred while being held in an inert gas atmosphere from said casting rolls to the entry side of said in-line rolling mill, is successively rolled by one pass by said rolling mill to a reduction of 5 to 50% within a temperature range in which an austenite structure exists in the matrix thereof, is thereafter transferred, and is then taken up into a coil form by a coiler.

(3) A twin-roll continuous casting method according to (2), wherein said inert gas atmosphere is held from a kiss point of said twin-roll to said entry side of said in-line rolling mill.

(4) A twin-roll continuous casting method according to (1) or (2), wherein said temperature range in which the austenite structure exists in said matrix is from 850° C. to 1,350° C.

(5) A twin-roll continuous casting method according to (1) or (2), wherein said temperature range in which the austenite structure exists in said matrix is from 900° C. to 1,250° C.

(6) A twin-roll continuous casting method according to (2) or (3), wherein said inert atmosphere is an inert atmosphere of an oxygen concentration of not higher than 5%.

(7) A twin-roll continuous casting method according to (2) or (3), wherein said inert atmosphere is an inert atmosphere of an oxygen concentration of not higher than 2%.

(8) A twin-roll continuous casting machine equipped with an in-line rolling mill for pouring a molten metal between a pair of water cooling casting rolls and rolling the resulting casting after solidification into a predetermined thickness, and with a coiler, characterized in that a cut-off housing for establishing therein an inert atmosphere is disposed between said casting rolls and the entry side of said in-line rolling mill.

(9) A twin-roll continuous casting machine according to (8), wherein a casting transfer distance regulator for regulating a casting transfer distance is provided to said cut-off housing.

(10) A twin-roll continuous casting machine according to (8) or (9), wherein a heater is provided to said cut-off housing.

(11) A twin-roll continuous casting machine according to any of (8) through (10), wherein a cooler is provided to said cut-off housing.

(12) A twin-roll continuous casting machine according to any of (8) through (11), wherein a thermometer for measuring the temperature of said casting immediately after solidification is provided to said cut-off housing.

(13) A twin-roll continuous casting machine according to any of (8) through (11), wherein a thermometer for measuring the temperature of said casting inside said cut-off housing is provided to said cut-off housing, and a temperature estimation device for estimating the temperature of said casting on the delivery side of said cut-off housing is also provided to said cut-off housing.

(14) A twin-roll continuous casting machine according to any of (8) through (13), wherein a thermoregulator device for regulating the temperature of said casting based on the data of said thermometer.

BRIEF DESCRIPTION OF THE DRAWINGS

FIG. 5(*b*) is a detail view of A portion in FIG. 5(*a*);

BEST MODE FOR CARRYING OUT THE INVENTION

Figure 1:
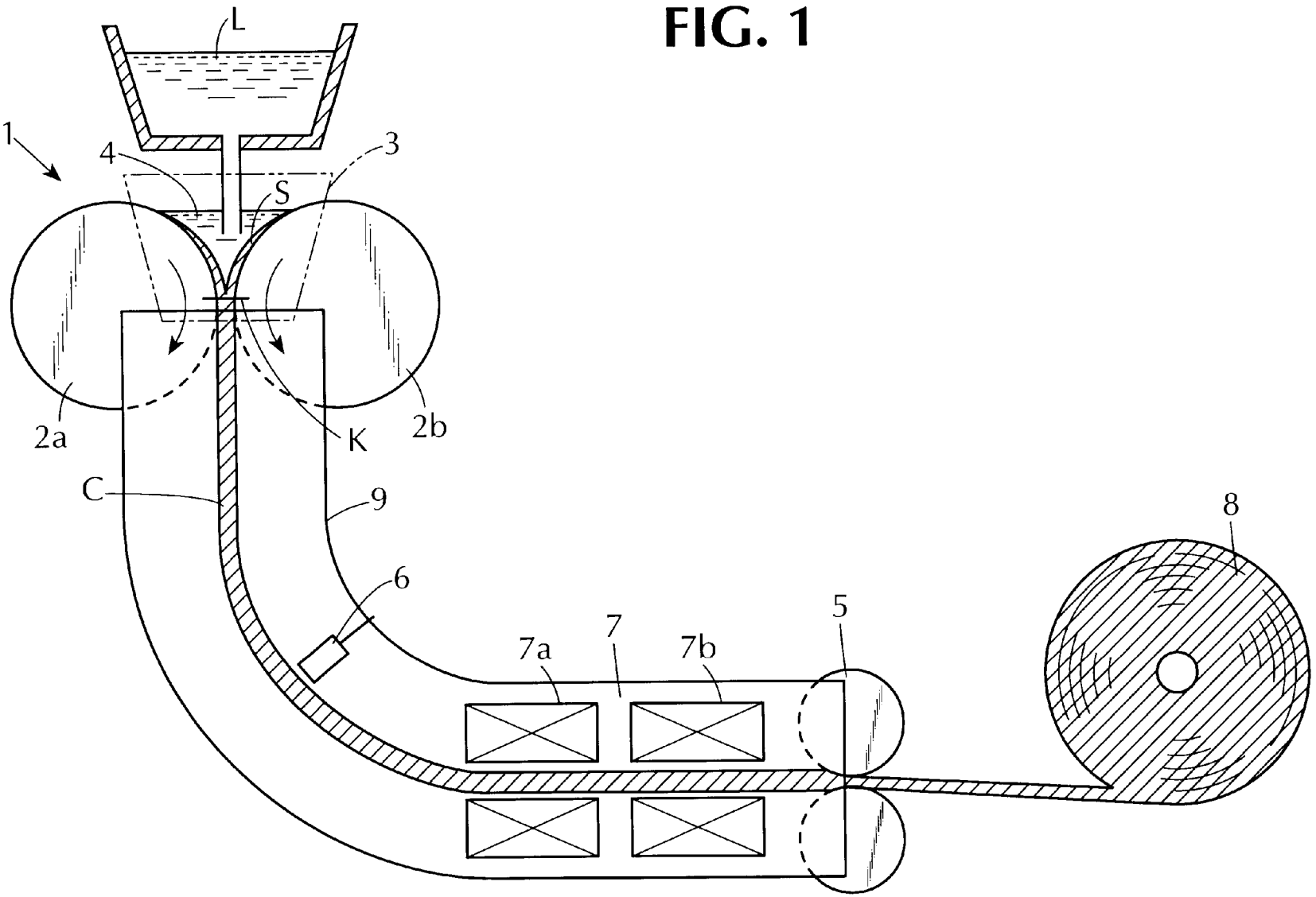
FIG. 1 is a schematic side view showing a twin-roll continuous casting machine according to one embodiment of the present invention.

According to the construction of the twin-roll continuous casting method of the present invention, after the casting is solidified and temperature-controlled by the pair of water cooling casting rolls, it is rolled to a predetermined sheet thickness by the in-line rolling mill. In other words, the rolling temperature of in-line rolling is regulated to the temperature range in which the austenite structure exists in the matrix of the casting, and the reduction is set to from 5 to 50%.

The temperature range in which the austenite structure exists in the matrix of the casting is concretely a temperature of 850° C. to less than 1,350° C., and the reason why the temperature is regulated to such a temperature range is to uniformly and finely reduce the crystal grain size of the casting to a fine grain size by a suitable rolling force. In other words, when the rolling temperature is less than 850° C., the rolling force becomes great and the recrystallization time gets elongated. Therefore, the production line must be elongated.

Moreover, when the rolling temperature is less than 850° C., it is possible that a ferrite transformation occurs and a final structure becomes a worked structure, with the result that the elongation remarkably lowers.

When the rolling temperature is higher than 1,350° C., on the other hand, the effect of uniforming the grain size can be obtained, but due to the high temperature, the crystal grains grow after rolling and the refining effect drops.

Moreover, the preferable range of the rolling temperature is 900 to less than 1,250° C. in the present invention.

The reason why the reduction is set to 5 to 50% is to obtain a strip having a desired surface roughness, a crystal grain size and elongation but free from processing skin roughness. In other words, when the reduction is less than 5%, the surface roughness and the crystal grain size become great, the elongation drops and processing skin roughness occurs. Further, when the reduction was less than 5%, variance of the as-cast materials cannot be reduced. In other words, a very small fluctuation of the sheet thickness and internal defects such as shrinkage cavity of the as-casted material cannot be eliminated, and variance of the materials occurs. On the other hand, when the reduction exceeds 50%, the surface roughness becomes non-uniform and accuracy of the sheet thickness also often is lowered due to strong working.

When the inert gas atmosphere is secured from the casting rolls to the entry side of the in-line rolling mill, high temperature oxidation of the casting can be prevented. In this case, when the atmosphere is an inert gas atmosphere of an oxygen concentration of not higher than 5%, roughness of scales adhering to the surface of the casting can be extremely lowered, and a strip with sound surface quality, e.g. small surface roughness, can be obtained.

Moreover, the preferable range of the oxygen concentration is less than 2% of the inert gas atmosphere in the present invention.

Figure 7:
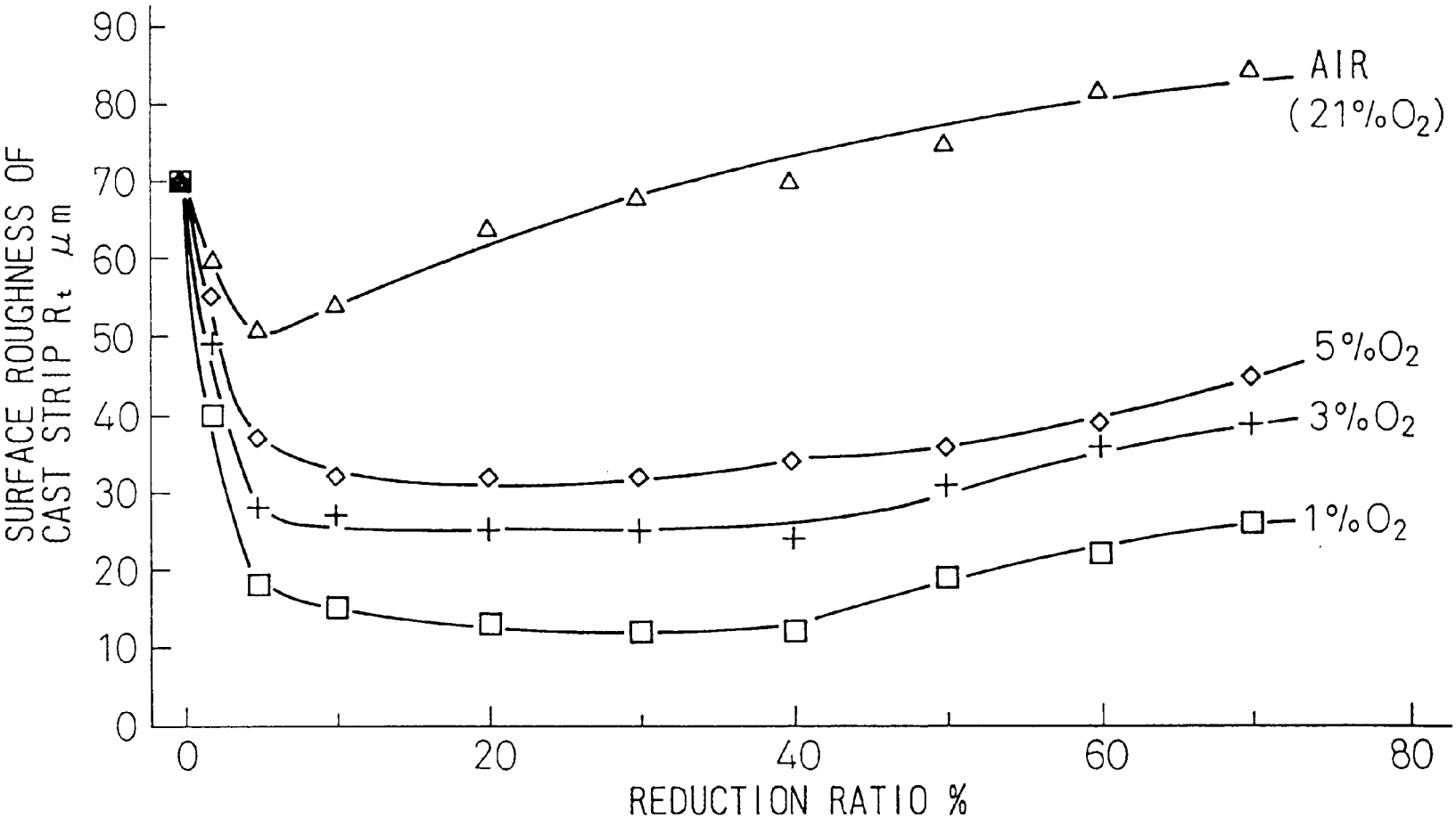
FIG. 7 is a graph showing the relation between a reduction and a surface roughness.

FIG. 7 shows the relationship between a reduction ratio % and a surface roughness Rt of the casting. The figure shows a result in C: 0.04% and in-line rolling temperature: 1,100° C. In air atmosphere (21% $O_2$), the surface roughness Rt increases with the reduction increment, with the result that the surface roughness is inferior than that in non in-line rolling.

However, in not higher than 5% of atmosphere oxygen, the reduction effect is small. If the reduction ratio will be selected in an appropriate range, the surface roughness Rt of around ½ of that in non in-line rolling can be obtained.

On the other hand, according to the construction of the twin-roll continuous casting machine, the casting machine is equipped with the in-line rolling mill for rolling the casting solidified by the pair of water cooling casting rolls into a predetermined sheet thickness. A thermometer for measuring the temperature of the casting immediately after solidification and a temperature regulator for regulating the temperature of the casting on the basis of the measurement value to the temperature such that the austenite structure exists in the matrix of the casting are disposed on the entry side of the in-line rolling mill. This temperature regulation is executed by adjusting a distance to the rolling mill, that is by adjusting an existing time in the cut-off housing.

When the temperature of the casting immediately after solidification, which is measured by the thermometer, is lower than the temperature range in which the austenite structure exists in the matrix of the casting, the casting may be heated by other means, e.g. a heater, to this temperature range and is then rolled by the in-line rolling mill. When the temperature of the casting is higher than the temperature range in which the austenite structure exists in the matrix of the casting, the casting may be cooled by other means, e.g. a cooler, to the temperature range described above and is then rolled by the in-line rolling mill. In this instance, if the reduction is set to 5 to 50%, a strip having a desired surface roughness, crystal grain size and elongation but devoid of ridging due to working can be obtained.

When a cut-off housing is formed between the casting rolls and the entry side of the in-line rolling mill and the inside of this housing is kept in the inert gas atmosphere, high temperature oxidation of the casting can be prevented.

The method for producing a steel sheet according the present process has been accomplished by finding that these characteristics of the material is improved and the variance of the material is remarkably reduced due to the one pass additive rolling of hot rolling after solidifying. After the rolling, it is desirably that the strip is water cooled and coiled at 500 to 700° C. as same as the present hot rolling process. On the other hand, a subsequent process of pickling, skin pass rolling, etc. may be conducted according to the present hot rolled steel sheet.

In the present invention, the variance of the material is shown by standard deviation $\sigma$ which is calculated from statistics processing of the overall elongation variance, at the time of executing JIS No. 5 tensile test. And a technical feature of the material in the present invention is within 5% of the standard deviation of the overall elongation.

Although the chemical components in the present invention are not particularly limited, the inventors of the present invention have acquired the following observation. Carbon is the most important element for determining the strength of the ordinary steel, and its amount of addition may be suitably selected in accordance with a desired strength.

Silicon, too, is added in a suitable amount as a solid solution reinforcement element in the ordinary steel. However, when its amount exceeds 1.5%, its pickling property will be deteriorated. Therefore, the amount is preferably not greater than 1.5%.

Manganese, too, is added to the ordinary steel as a reinforcement element in the same way as C and Si. Generally, Mn is added in an amount at least five times the amount of sulfur in order to prevent hot brittleness resulting from S. However, from the aspect of weldability, the amount of Mn is preferably not greater than 2%.

Basically, the amounts of phosphorous and sulfur are as small as possible, but no problem substantially occurs so long as their amount is not greater than 0.05% because unnecessary ultra-low phosphoration and ultra-low sulfurization will invite the cost of increase during the steel production process.

Other elements contained in the steel are not particularly limited, either, in the present invention. For example, trace amounts of Nb, Ti, V, B, etc., are added to the steel in order to improve the mechanical properties of the steel material such as strength and ductility, but the present invention are not at all affected by the addition of these elements. On the other hand, when the scrap is used as the primary raw material, elements such as Cu, Sn, Cr, Ni, etc., mix as unavoidable elements, but the present invention is not at all impeded by the presence/absence of these elements.

EXAMPLES

Example 1

Preferred embodiments of the twin-roll continuous casting method and the apparatus therefor according to the present invention will be described in detail with reference to the accompanying drawings.

FIG. 1 is a schematic side view showing an embodiment of the twin-roll continuous casting machine according to the present invention. In the twin-roll continuous casting machine 1 of this embodiment, a pair of casting rolls 2*a* and 2*b* each equipped with a water cooling function are disposed with a predetermined gap between them as shown in the drawing. Side weirs 3 are disposed at both end portions of these casting rolls 2*a*, 2*b*, and a hot well 4 for storing a molten metal L is formed at the portion defined by these members.

The molten metal L is charged from above into the hot well 4. When the casting rolls 2*a*, 2*b* are rotated inwardly downward while being cooled with water, the molten metal L is brought into contact with the casting rolls 2*a*, 2*b*, is cooled by water, and is solidified in an arcuate form on the surface of each casting roll 2*a*, 2*b*, as a solidified shell S. Each solidified shell S is brought close to the other with the rotation of the casting rolls 2*a*, 2*b*, is bonded at a roll kiss point K and is converted to a casting C having a predetermined thickness. The casting C is then pulled out downward from between the casting rolls 2*a*, 2*b*.

An in-line rolling mill 5 for rolling the solidified casting C into a predetermined sheet thickness by hot rolling is provided on the downstream side of the casting rolls 2*a*, 2*b*. An ordinary rolling mill is used for this in-line rolling mill, but because a reduction of from 5 to 50% is employed for the sheet thickness of the casting C, a rolling mill having such a reduction capacity is used.

A thermometer 6 for measuring the temperature of the casting C immediately after solidification and a temperature regulator 7 for regulating the temperature of the casting C within the temperature range in which an austenite structure (γ) exists in the matrix on the basis of the measurement value are disposed on the entry side of the in-line rolling mill 5. Besides a thermo-couple of platinum-platinum rhodium (Pt—Rh), for example, a thermometer capable of measuring the temperature within the range of from about 700 to about 1,500° C. is used as the thermometer 6 described above. A heater 7*a* such as a high frequency induction heater or a warmer and/or a cooler 7*b* such as a water cooler is used as the temperature regulator 7.

The other of the warmer is preferably a steel cover, etc. pasted innerside by refractories (e.g. fabric kaolin). The other of the heater is preferably a gas burner, etc. More, the other of the cooler is preferably a movable roll for adjusting cooling due to time increment during transferring, a pneumato-hydato cooler, etc. However, the present invention does not restrict those.

More concretely, when the temperature of the casting C immediately after solidification is measured by the thermometer 6 and the measurement value is out of the temperature zone in which the austenite structure (γ) exists in the matrix of the casting C, the regulator 7 heats or cools the casting C and regulates the rolling temperature. In other words, when the temperature of the casting C is lower than 850° C. the casting C is heated by the heater 7*a* to 850° C. but less than 1,350° C. and is then rolled by the in-line rolling mill 5. On the other hand, when the temperature of the casting C is higher than 1,350° C., the casting is cooled by the cooler 7*b* to the temperature ranging from 850° C. to less than 1,350° C., and is then rolled by the in-line rolling mill 5.

The thin casting C rolled by the in-line rolling mill 5 is sequentially taken up by a coiler 8 disposed on the downstream side of the in-line rolling mill 5.

A cut-off housing 9 is disposed from the casting rolls 2*a*, 2*b* to the entry side of the in-line rolling mill 5 in such a manner as to encompass the conveyor line of the casting C. An exhaust apparatus (not shown) for exhausting the inside of this cut-off housing 9 and a gas feeder (not shown) for supplying an inert gas such as argon (Ar), nitrogen ($N_2$), etc., into the housing 9 are connected to the cut-off housing 9.

Next, the twin-roll continuous casting method of the first embodiment which is practiced by using the twin-roll continuous casting machine 1 described above will be explained. The casting rolls 2*a*, 2*b* of the twin-roll continuous casting machine 1 are shaped into a roll width of 350 mm and a roll diameter of 400 mmϕ, and are Cu rolls of an internal water cooling system. The casting condition is set to a casting rate of 30 m/min and a casting sheet thickness of 3.0 mm. The inside of the cut-off housing 9 is set to an inert gas atmosphere of 1% 02. The in-line rolling mill 5 is set to 2 stages, one stage and a work roll diameter of 300 mmϕ. A low carbon aluminum killed steel (0.04% C) is used as the casting material. The casting is cooled with water and is taken up at 650° C.

Experiments were carried out under the conditions described above by the twin-roll continuous casting method of the first embodiment at the rolling temperature of 1,100° C. for the in-line rolling mill 5 at reductions of 0%, 2%, 5%, 10%, 20%, 30%, 40%, 50%, 60% and 70% so as to confirm the surface roughness (μm), the crystal grain size (μm), strength (kgf/mm$^2$), elongation (%) and working skin roughness (ridging).

The results of the experiments are tabulated in Table 1. By the way, the results of the experiments were based on the standard of approval stipulating the surface roughness of not greater than 20 μm, the crystal grain size of 20 to 30 μm, the strength of at least 36 kgf/mm$^2$, elongation of at least 34% and the working skin roughness (ridging) of non-occurrence of seam due to ridging. As to the strength and the elongation, 35 JIS 5 tensile testpieces were prepared from the resulting steel sheet and were subjected to the tensile test, and the total elongation so obtained were subjected to statistic processing so as to determine the mean value and the standard deviation.

TABLE 1

| Reduction (%) | Surface roughness (μm) | Grain size (μm) | Target strength kgf/mm$^2$ | Elongation (%) | Working skin roughness (ridging) |
|---|---|---|---|---|---|
| 0 | 70 | 100 | 36 | 17 | Occurred |
| 2 | 40 | 75 | 36 | 26 | Occurred |
| 5 | 18 | 30 | 36 | 34 | None |
| 10 | 15 | 26 | 36 | 43 | None |
| 20 | 13 | 22 | 36 | 43 | None |
| 30 | 12 | 21 | 36 | 43 | None |
| 40 | 12 | 21 | 36 | 43 | None |
| 50 | 19 | 21 | 36 | 43 | None |
| 60 | 22 | 21 | 36 | 43 | None |
| 70 | 26 | 21 | 36 | 43 | None |

As shown in Table 1, the approved value (below 20 μm) of the surface roughness was obtained at the reduction of 5 to 50%. The approved value (20 to 30 μm) of the crystal grain size was obtained at the reduction of 5 to 70%. The approved value (at least 34%) of the elongation was obtained at the reduction of 5 to 70%, and the approved value (none) of the working skin roughness (ridging) was obtained at the reduction of 5 to 70%.

In other words, it was confirmed that in the twin-roll continuous casting method of the first embodiment, the strip having the desired surface roughness (not greater than 20 μm), the crystal grain size (20 to 30 μm) and the elongation (at least 34%) but devoid of the working skin roughness (ridging) could be obtained by rolling the casting C of the low carbon aluminum killed steel (0.04% C) at the reduction temperature of 1,100° C. and at the reduction of 5 to 50%.

Example 2

In this second embodiment, the casting material of the first embodiment is changed. More concretely, the second embodiment used a medium carbon aluminum killed steel (0.13% C), and the rest of the construction were the same as those of the first embodiment.

Experiments were carried out under the condition described above by the twin-roll continuous casting method of the second embodiment at a rolling temperature of the in-line rolling mill 5 at 1,100° C. and reductions of 0%, 2%, 5%, 10%, 20%, 30%, 40%, 50%, 60% and 70% so as to confirm the surface roughness (μm), the crystal grain size (μm), the strength (Kgf/mm$^2$), the elongation (%) and working skin roughness (ridging).

The results of the experiments are tabulated in Table 2. The results of the judgement were based on the same standard of approval with the exception that the strength was set to at least 40 kgf/mm$^2$.

TABLE 2

| Reduction (%) | Surface roughness (μm) | Grain size (μm) | Target strength kgf/mm$^2$ | Elongation (%) | Working skin roughness (ridging) |
|---|---|---|---|---|---|
| 0 | 72 | 105 | 40 | 15 | Occurred |
| 2 | 42 | 74 | 40 | 20 | Occurred |
| 5 | 15 | 32 | 40 | 29 | None |
| 10 | 14 | 24 | 40 | 37 | None |
| 20 | 13 | 21 | 40 | 39 | None |
| 30 | 12 | 20 | 40 | 39 | None |
| 40 | 12 | 20 | 40 | 41 | None |
| 50 | 19 | 21 | 40 | 43 | None |
| 60 | 23 | 19 | 40 | 41 | None |
| 70 | 28 | 21 | 40 | 43 | None |

As tabulated in Table 2, the approved value (not greater than 20 μm) of the surface roughness was obtained at the reduction of 5 to 50%, and the approved value (20 to 30 μm) of the crystal grain size was obtained at the reduction of 10 to 50%. The approved value (at least 34%) of the elongation was obtained at the reduction of 10 to 70%, and the approved value (none) of the working surface roughness (ridging) was obtained at the reduction of 5 to 70%.

In other words, it was confirmed that in the twin-roll continuous casting method of the second embodiment, that a strip having the desired surface roughness (not greater than 20 μm), the crystal grain size (20 to 30 μm) and the elongation (at least 34%) but devoid of the ridging could be obtained by rolling the casting C of the medium carbon aluminum killed steel (0.13% C) at the rolling temperature of 1,100° C. and at the reduction of 10 to 50% by the in-line rolling mill 5.

Example 3

In the third embodiment, the rolling temperature in the first embodiment was changed, and the rest of the conditions were the same as those of the first embodiment.

More concretely, experiments were carried out by the twin-rolling continuous casting method of the third embodiment at a rolling temperature of the in-line rolling mill 5 at 850° C. and reductions of 0%, 2%, 5%, 10%, 20%, 30%, 40%, 50%, 60% and 70% so as to confirm the surface roughness (μm), the crystal grain size (μm), the strength (kgf/mm$^2$), the elongation (%) and working skin roughness (ridging).

The results were tabulated in Table 3. The same standard of approval as that of the first embodiment was used for the judgement of the results.

TABLE 3

| Reduction (%) | Surface roughness (μm) | Grain size (μm) | Target strength kgf/mm$^2$ | Elongation (%) | Working skin roughness (ridging) |
|---|---|---|---|---|---|
| 0 | 70 | 100 | 36 | 17 | Occurred |
| 2 | 50 | 80 | 36 | 24 | Occurred |
| 5 | 19 | 35 | 36 | 27 | None |
| 10 | 18 | 33 | 36 | 34 | None |
| 20 | 17 | 28 | 36 | 36 | None |
| 30 | 16 | 24 | 36 | 39 | None |
| 40 | 15 | 22 | 36 | 39 | None |
| 50 | 18 | 22 | 36 | 39 | None |
| 60 | 26 | 22 | 36 | 41 | None |
| 70 | 28 | 22 | 36 | 41 | None |

As tabulated in Table 3, the approved value (not greater than 20 μm) of the surface roughness could be obtained at the reduction of 5 to 50%, and the approved value (20 to 30 μm) of the crystal grain size could be obtained at the reduction of 20 to 70%. The approved value (at least 34%) of the elongation could be obtained at the reduction of 10 to 70%, and the approved value (none) of the ridging could be obtained at the reduction of 5 to 70%.

In other words, it was confirmed that in the twin-rolling continuous casting method of the third embodiment, a strip having the desired surface roughness (not greater than 20 μm), the crystal grain size (20 to 30 μm) and the elongation (at least 34%) but devoid of the ridging could be obtained by rolling the casting C of the low carbon aluminum killed steel (0.04% C) at a rolling temperature of 850° C and the reduction of 20 to 50% by the in-line rolling mill 5.

Example 4

In the fourth embodiment, the rolling temperature in the first embodiment was changed, and the rest of the conditions were the same as those of the first embodiment.

More concretely, experiments were carried out by the twin-roll continuous casting method of the fourth embodiment at a rolling temperature of the in-line rolling mill 5 at 1,300° C. and reduction of 0%, 2%, 5%, 10%, 20%, 30%, 40%, 50%, 60% and 70% so as to confirm the surface roughness (μm), the crystal grain size (μm), the strength (kgf/mm$^2$), the elongation and the working skin roughness (ridging).

The results of the experiments were tabulated in Table 4. The same standard of approval as that of the first embodiment was used for the judgement of the results.

TABLE 4

| Reduction (%) | Surface roughness (μm) | Grain size (μm) | Target strength kgf/mm$^2$ | Elongation (%) | Working skin roughness (ridging) |
|---|---|---|---|---|---|
| 0 | 70 | 100 | 36 | 17 | Occurred |
| 2 | 30 | 78 | 36 | 24 | Occurred |
| 5 | 16 | 30 | 36 | 34 | None |

TABLE 4-continued

| Reduction (%) | Surface roughness (μm) | Grain size (μm) | Target strength kgf/mm² | Elongation (%) | Working skin roughness (ridging) |
|---|---|---|---|---|---|
| 10 | 14 | 26 | 36 | 39 | None |
| 20 | 13 | 23 | 36 | 41 | None |
| 30 | 13 | 24 | 36 | 43 | None |
| 40 | 11 | 22 | 36 | 41 | None |
| 50 | 16 | 21 | 36 | 42 | None |
| 60 | 22 | 22 | 36 | 44 | None |
| 70 | 25 | 21 | 36 | 42 | None |

As tabulated in Table 4, the approved value (not greater than 20 μm) could be obtained at the reduction of 5 to 50%, and the approved value (20 to 30 μm) of the crystal grain size could be obtained at the reduction of 5 to 70%. The approved value (at least 34%) of the elongation could be obtained at the reduction of 5 to 70%, and the approved value (none) of the ridging could be obtained at the reduction of 5 to 70%.

In other words, it was confirmed that in the twin-roll continuous casting method of the fourth embodiment, a strip having the desired surface roughness (not greater than 20 μm), the crystal grain size (20 to 30 μm) and the elongation (at least 34%) but devoid of the working skin roughness could be obtained by rolling the casting C of the low carbon aluminum killed steel (0.04% C) at the rolling temperature of 1,300° C. and the reduction of 5 to 50% by the in-line rolling mill 5.

Comparative Example 1

Next, the first Comparative Example, which was carried out in order to confirm the function and effects of the twin-roll continuous casting methods of the first to fourth embodiments, will be explained. In this first Comparative Example, the rolling temperature in the first embodiment was changed. More concretely, comparative experiments were carried out at a rolling temperature of 750° C. and reductions of 0%, 2%, 5%, 10%, 20%, 30%, 40%, 50%, 60% and 70% so as to confirm the surface roughness (μm), the crystal grain size (μm), the strength (kgf/mm²), the elongation (%) and the working skin roughness (ridging).

The results of the experiments were tabulated in Table 5. The same standard of approval as that of the first embodiment was used for the judgement of the results.

TABLE 5

| Reduction (%) | Surface roughness (μm) | Grain size (μm) | Target strength kgf/mm² | Elongation (%) | Working skin roughness (ridging) |
|---|---|---|---|---|---|
| 0 | 70 | 100 | 36 | 17 | Occurred |
| 2 | 50 | 85 | 36 | 29 | Occurred |
| 5 | 19 | 45 | 36 | 26 | Occurred |
| 10 | 17 | 40 | 36 | 29 | Occurred |
| 20 | 16 | 37 | 36 | 30 | Occurred |
| 30 | 15 | 36 | 36 | 31 | Occurred |
| 40 | 15 | 32 | 36 | 31 | Occurred |
| 50 | 19 | 31 | 36 | 30 | Occurred |
| 60 | 27 | 31 | 36 | 31 | Occurred |
| 70 | 28 | 31 | 36 | 31 | Occurred |

As tabulated in Table 5, the elongation (%) dropped below 34% when the crystal grain size exceeded 30 μm at all the reduction ratios, the ridging occurred, and the resulting strips failed to pass the standard of judgement.

In other words, in the first Comparative Example, even when the casting C of the low carbon aluminum killed steel (0.04% C) was rolled at the reduction s of 0 to 70% by the in-line rolling mill 5, sound strips could not be obtained at the rolling temperature of 750° C.

Comparative Example 2

In this second Comparative Example, the rolling temperature in the first embodiment was changed. More concretely, experiments were carried out at a rolling temperature of 1,350° C. and reductions of 0%, 2%, 5%, 10%, 20%, 30%, 40%, 50%, 60% and 70% so as to confirm the surface roughness (μm), the crystal grain size (μm), the strength (kgf/mm²), the elongation (%) and the working skin roughness (ridging).

The results of the experiments were tabulated in Table 6. The same standard of approval as that of the first embodiment was used for the judgement of the results.

TABLE 6

| Reduction (%) | Surface roughness (μm) | Grain size (μm) | Target strength kgf/mm² | Elongation (%) | Working skin roughness (ridging) |
|---|---|---|---|---|---|
| 0 | 70 | 100 | 36 | 17 | Occurred |
| 2 | 31 | 88 | 36 | 20 | Occurred |
| 5 | 15 | 39 | 36 | 24 | Occurred |
| 10 | 13 | 35 | 36 | 26 | Occurred |
| 20 | 12 | 37 | 36 | 29 | Occurred |
| 30 | 13 | 36 | 36 | 30 | Occurred |
| 40 | 14 | 38 | 36 | 31 | Occurred |
| 50 | 18 | 35 | 36 | 32 | Occurred |
| 60 | 25 | 32 | 36 | 34 | None |
| 70 | 28 | 31 | 36 | 34 | None |

As tabulated in Table 6, the crystal grain size exceeded 30 μm at all the reduction ratios, the elongation dropped below 34% and the ridging occurred at the reduction ratios of 0 to 50%, and the resulting strips failed to pass the standard of judgement.

In other words, in the second Comparative Example, even when the casting C of the low carbon aluminum killed steel (0.04% C) was rolled at the reductions of 0 to 70% by the in-line rolling mill 5, sound strips could not be obtained at the rolling temperature of 1,350° C.

As described above, it was found out by comparing the twin-roll continuous casting methods of the first to fourth embodiments with the first and second Comparative Examples that the strips having the desired surface roughness (not greater than 20 μm), the crystal grain size (20 to 30 μm) and the elongation (at least 34%) but devoid of the working skin roughness could be obtained by casting the castings C of the carbon steel at the rolling temperature of 850° C. to less than 1,350° C. and at the reductions of 5 to 50% by the in-line rolling mill 5. Because the twin-roll continuous casting method according to the present invention can produce the product thin sheet by directly conducting hot rolling during the transfer of the casting C without effecting cold rolling as described above, it can drastically reduce the cost of equipment as well as the cost of production.

The temperature range of from 850° C. to less than 1,350° C. of the rolling temperature described above is the temperature zone in which the austenite structure (γ) exists in the matrix of the casting C and more concretely, it is the range where the ferrite structure (α) and the austenite structure (γ) co-exist or a single layer zone of the austenite structure (γ).

As described above, the suitable condition of the reduction with respect to the sheet thickness of the casting C somewhat changes depending on the rolling temperature and the kind of the steel in each of the foregoing embodiments, but a desired strip can be reliably obtained within the range of the reduction of 20% to 50%. By the way, the twin-roll continuous casting method according to the present invention is directed to the carbon steel having the carbon content within the range of 0.0005% to 1.0% C.

Figure 2:
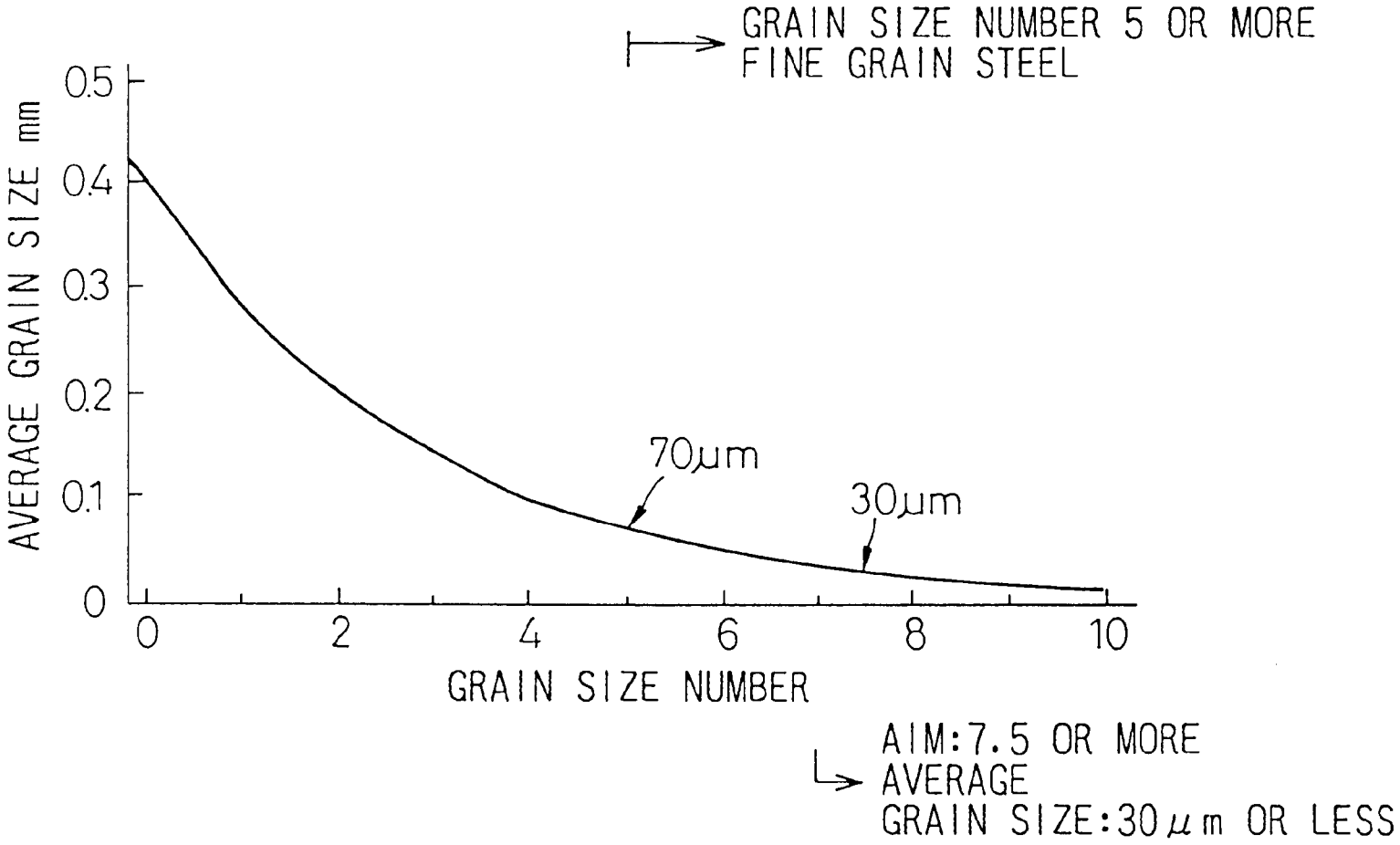
FIG. 2 is a graph showing the relation between a mean crystal grain size and a crystal grain number.
Figure 3:
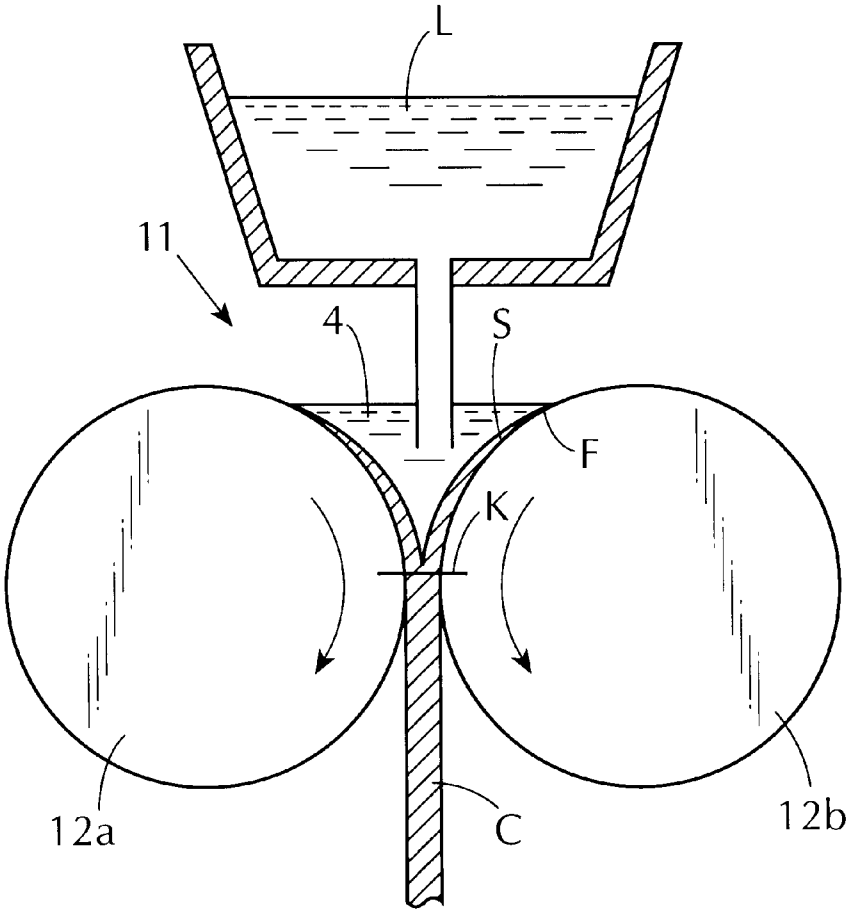
FIG. 3 PRIOR ART
FIG. 3 is a side view showing the principal portions of a conventional twin-roll continuous casting machine.

It is particularly noteworthy in the present invention that the present invention can obtain the product thin sheet having a crystal grain size of 20 to 30 μm. FIG. 2 is a graph showing the relation between the mean crystal grain size and the crystal grain size number. As shown in the graph, the carbon steels having a grain size number of 5 or more are generally called "fine grain steel" (refer to "Lectures on Iron and Steel Technologies, New Edition", Vol. 3, Properties of Steel Materials and Tests, pp. 414–419, edited by The Iron and Steel Institute of Japan). It can be seen that when the crystal grain size is below 30 μm, the steel is a fine grain steel having a grain size number of 7.5 or more.

In other words, the twin-roll continuous casting method according to the present invention can increase the ferrite grain size to the grain size number of at least 7.5 in the as-cast casting C by applying mild rolling at a reduction of 5 to 50% during the transfer of the casting C, and can thus produce the thin sheet casting having the fine grain texture which is homogeneous from the surface to the inside of the casting and in both transverse and longitudinal directions.

Example 5

In this fifth embodiment, the internal atmosphere of the cut-off housing 9 in the first embodiment was changed. More concretely, the inside of the cut-off housing 9 was set to an inert gas atmosphere of 2% $O_2$, and the rest of the conditions were the same as those of the first embodiment.

More concretely, experiments were carried out by the twin-roll continuous casting method of the fifth embodiment at a rolling temperature of the in-line rolling mill 5 of 1,100° C and reductions of 0%, 2%, 5%, 10%, 20%, 30%, 40%, 50%, 60% and 70%, so as to confirm the surface roughness (μm), the crystal grain size (μm), the strength (kgf/mm$^2$), the elongation (%) and the working skin roughness (ridging).

The results were tabulated in Table 7. The same standard of approval as that of the first embodiment was used for the judgement of the results.

TABLE 7

| Reduction (%) | Surface roughness (μm) | Grain size (μm) | Target strength kgf/mm$^2$ | Elongation (%) | Working skin roughness (ridging) |
|---|---|---|---|---|---|
| 0 | 70 | 100 | 36 | 17 | Occurred |
| 2 | 43 | 75 | 36 | 27 | Occurred |
| 5 | 20 | 30 | 36 | 34 | None |
| 10 | 17 | 25 | 36 | 41 | None |
| 20 | 16 | 23 | 36 | 43 | None |
| 30 | 15 | 21 | 36 | 42 | None |
| 40 | 14 | 22 | 36 | 43 | None |
| 50 | 20 | 21 | 36 | 45 | None |
| 60 | 26 | 20 | 36 | 43 | None |
| 70 | 29 | 21 | 36 | 43 | None |

As tabulated in Table 7, the approved value (not greater than 20 μm) of the surface roughness could be obtained at the reduction of 5 to 50%, and the approved value (20 to 30 μm) of the crystal grain size could be obtained at the reduction of 5 to 70%. The approved value (36 kgf/mm$^2$ or more) of the strength could be obtained at all the reductions, and the approved value (at least 34%) of the elongation could be obtained at the reduction of 5 to 70%. The approved value (none) of the ridging could be obtained at the reduction of 5 to 70%.

In other words, it was confirmed that in the twin-rolling continuous casting method of the fifth embodiment, a strip having the desired surface roughness (not greater than 20 μm), the crystal grain size (20 to 30 μm) and the elongation (at least 34%) but devoid of the ridging could be obtained by rolling the casting C of the low carbon aluminum killed steel (0.04% C) at the rolling temperature of 1,100° C. and at the reduction of 5 to 50% by the in-line rolling mill 5 in the inert atmosphere of 2% $O_2$.

Comparative Example 3

On the other hand, the third Comparative Example, which was carried out to confirm the function and effect of the twin-roll continuous casting method of the fifth embodiment, will be explained. In this third Comparative Example, the internal atmosphere of the cut-off housing 9 in the fifth embodiment was changed. More concretely, the inside of the cut-off housing 9 was set to the inert gas atmosphere of 3% $O_2$, and comparative experiments were carried out at a rolling temperature of 1,100° C. and a reduction s of 0%, 2%, 5%, 10%, 20%, 30%, 40%, 50%, 60% and 70% so as to confirm the surface roughness (μm), the crystal grain size (μm), the strength (kgf/mm$^2$), the elongation (%) and the working skin roughness (ridging).

The results of the experiments were tabulated in

Table 8. The same standard of approval as that of the first embodiment was used for the judgement of the results.

TABLE 8

| Reduction (%) | Surface roughness (μm) | Grain size (μm) | Target strength kgf/mm$^2$ | Elongation (%) | Working skin roughness (ridging) |
|---|---|---|---|---|---|
| 0 | 70 | 100 | 36 | 17 | Occurred |
| 2 | 49 | 76 | 36 | 26 | Occurred |
| 5 | 28 | 29 | 36 | 36 | None |
| 10 | 27 | 24 | 36 | 39 | None |
| 20 | 25 | 23 | 36 | 43 | None |
| 30 | 25 | 22 | 36 | 42 | None |
| 40 | 24 | 22 | 36 | 43 | None |
| 50 | 31 | 21 | 36 | 45 | None |
| 60 | 36 | 21 | 36 | 43 | None |
| 70 | 39 | 21 | 36 | 45 | None |

As tabulated in Table 8, the surface roughness exceeded 20 μm at all the reductions, and the resulting strips failed to pass the standard of approval.

In other words, in the third embodiment, even when the casting C of the low carbon aluminum killed steel (0.04% C) was rolled at the rolling temperature of 1,100° C. and at the reduction of 5 to 50% by the in-line rolling mill 5, the surface roughness increased at the inert gas atmosphere of 3% $0_2$, and sound strips could not be obtained.

As described above, it was found out by comparing the twin-roll continuous casting method of the fifth embodiment with the third Comparative Example, the roughness of scales adhering to the surface of the casting C remarkably dropped when the gas atmosphere was set to the inert gas atmosphere of the oxygen concentration of not greater than 2%, and the strips devoid of the ridging could be obtained by applying hot rolling.

Example 6

Next, the twin-roll continuous casting method according to the sixth embodiment will be explained. The kind of the steel was a low carbon aluminum killed steel (0.04% C), the rolling temperature was 1,100° C., and the reductions were 2%, 5%, 10% and 20%. The casting was cooled with water after rolling and was taken up at 650° C.

At the reduction of 0%, that is, in the case of the as-cast material, and at the reduction of 2%, the standard deviation exceeds 7%. Particularly because the as-cast material has extremely great material variance, the mean value is low. When rolling is carried out at a reduction of 5% or more, on the other hand, the standard deviation remains within 5%, and the mean value remains substantially constant, too, irrespective of the reduction.

TABLE 9

| Reduction (%) | Total elongation Mean (%) | Total elongation Standard deviation (%) | Remarks |
|---|---|---|---|
| 0 (Non Rolling) | 27 | 10.6 | Comparative ex. |
| 2 | 33 | 7.2 | Comparative ex. |
| 5 | 37 | 4.5 | This invention |
| 10 | 38 | 3.8 | This invention |
| 20 | 39 | 3.0 | This invention |

cooled with water and taken up at 550 to 670° C. The mechanical tests and the mechanical properties were examined in the same way as in the sixth embodiment. The test results were also described in the right-hand column of Table 11. In all of Nos. 1 to 6 satisfying the condition of the present invention, the standard deviation of the total elongation was within 5%, but No. 7 which was the as-cast material and No. 8 which had the reduction of 3% exhibited the standard deviation of more than 5%, and the material variance was great.

In No. 9 having a rolling temperature as low as 750° C., the elongation value itself was low.

TABLE 10

(wt %)

| Kind of steel | C | Si | Mn | P | S | Al | N | Other elements |
|---|---|---|---|---|---|---|---|---|
| A | 0.021 | 0.02 | 0.17 | 0.012 | 0.009 | 0.021 | 0.005 | B: 0.0021 |
| B | 0.043 | 0.04 | 0.32 | 0.010 | 0.011 | 0.042 | 0.004 | Cu: 0.12, Sn: 0.02 |
| C | 0.15 | 0.12 | 0.81 | 0.015 | 0.012 | 0.039 | 0.005 | Cr: 0.26, V: 0.04 |

TABLE 11

| No. | Kind of steel | Casting thickness (mm) | Rolling temperature (° C.) | Reduction (%) | Yield strength (kgf/mm$^2$) | Tensile strength (kgf/mm$^2$) | Total elongation Mean (%) | Total elongation Standard deviation (%) | Remarks |
|---|---|---|---|---|---|---|---|---|---|
| 1 | A | 3.2 | 1100 | 10 | 23.6 | 32.3 | 39 | 3.3 | This invention |
| 2 | A | 1.8 | 1200 | 6 | 23.7 | 32.2 | 38 | 4.2 | This invention |
| 3 | B | 4.5 | 1050 | 15 | 25.2 | 34.6 | 36 | 3.0 | This invention |
| 4 | B | 6.0 | 1000 | 20 | 24.4 | 34.9 | 36 | 2.9 | This invention |
| 5 | C | 3.2 | 1100 | 5 | 33.1 | 46.7 | 33 | 4.6 | This invention |
| 6 | C | 3.5 | 950 | 10 | 32.8 | 46.3 | 32 | 3.5 | This invention |
| 7 | A | 3.2 | (Non Rolling) | 0 | 23.4 | 32.5 | 26 | 9.4 | Comparative Ex. |
| 8 | A | 4.5 | 1100 | 3 | 23.7 | 32.3 | 32 | 7.9 | Comparative Ex. |
| 9 | A | 3.2 | 750 | 15 | 30.5 | 32.6 | 19 | 3.1 | Comparative Ex. |

Underline: out of range of this invention.

Example 7

Next, the twin-roll continuous casting method according to the seventh embodiment will be explained. Steels having various components tabulated in Table 10 were continuously casted to various casting thickness shown in Table 11, and were then rolled by variously changing the rolling temperatures and reduction s. Thereafter, the resulting strips were

Example 8

Next, the twin-roll continuous casting apparatus according to the eighth embodiment will be explained.

Figure 4:
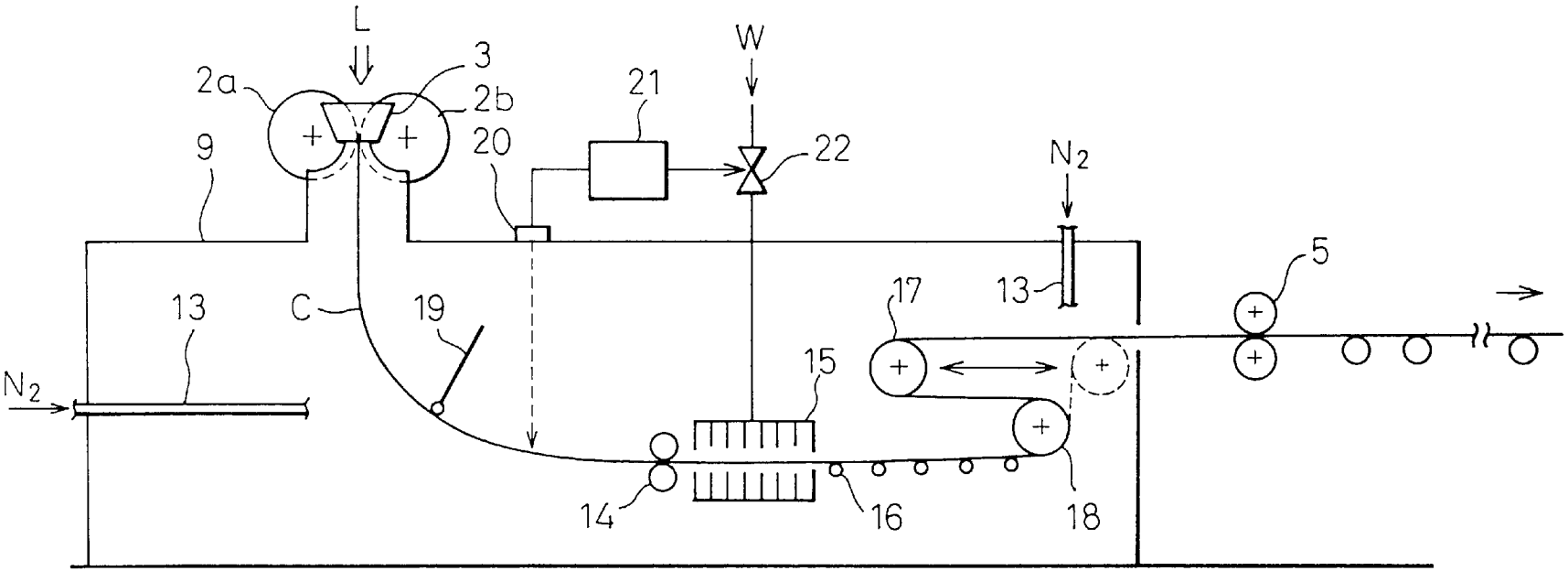
FIG. 4 is a side view showing a cut-off housing for establishing therein an inert atmosphere.

The twin-roll continuous casting machine is shown as a side view in FIG. 4. In this figure, the molten metal L is stored in a sectioned portion by the side weirs 3 and the casting rolls 2*a* and 2*b*, and said casting rolls rotate inwardly downward while being cooled with water. The casting C having a predetermined thickness is converted by bonding at roll kiss point and pulled out downward from between the casting rolls 2*a* and 2*b*. In the apparatus of this embodiment, the cut-off housing 9 seals from delivery side of the casting rolls 2*a* and 2*b* to the in-line rolling mill 5. Nitrogen gas is fed through a nitrogen gas pipe 13 so as to hold inert gas atmosphere inside the cut-off housing 9.

Inside the cut-off housing 9, a loop detector 19, a pinch roll 14, cooling zone 15 and a transfer roll 16 are disposed. More, in the delivery side of the cut-off housing 9, a pair of transfer roll in which one is a movable roll 17 and the other is a fixed roll 18 is disposed for adjusting the transfer distance. More, the casting temperature is measured by a thermometer 20 and the data is used for regulating a flow adjusting valve 22 of the cooling water W through a converter 21.

Figure 5A:
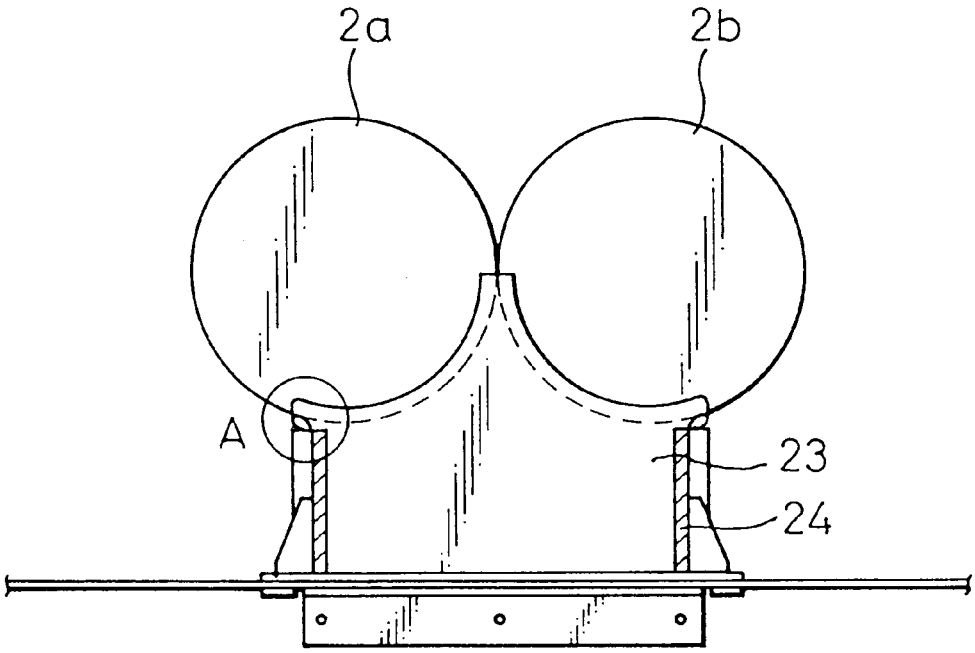
FIG. 5(*a*) is a side view showing a cut-off housing in the vicinity of the twin-roll.
Figure 5B:
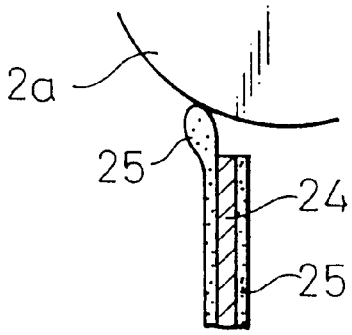
Figure 6:
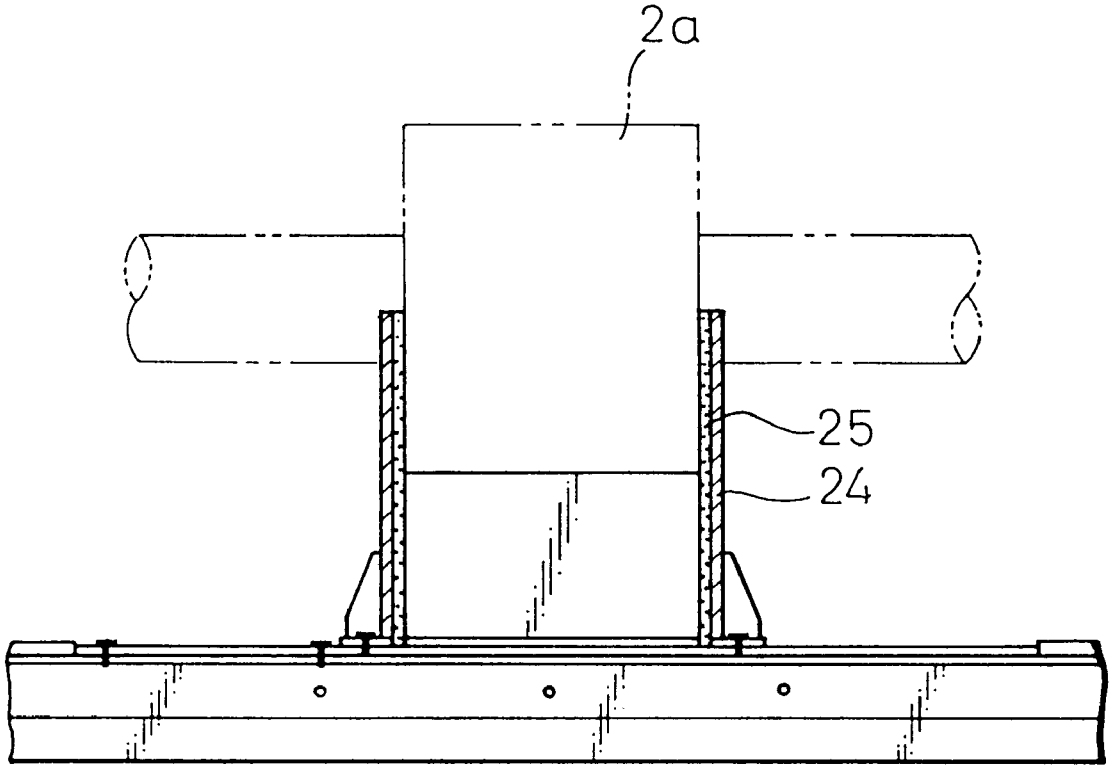
FIG. 6 is a front view showing a cut-off housing in the vicinity of the twin-roll.

FIG. 5(*a*) shows the cut-off housing 23 under the casting rolls, and FIG. 5(*b*) is a magnified view of A portion in FIG. 5(*a*). FIG. 6 is a front view of the cut-off housing 23 under the casting rolls.

From these figures, the cut-off housing is disposed from the roll kiss point, the steel plate 24 at outside end portion is secured to maintain entirely sealing by pasting a fabric kaolin 25 thereon. More, the space between the steel plate 24 and the casting rolls is held in an inert atmosphere by sliding the fabric kaolin.

INDUSTRIAL APPLICABILITY

As described above, according to the twin-roll continuous casting method and the apparatus of the present invention, a thin sheet having excellent mechanical strength, devoid of skin roughness and having excellent surface roughness could be obtained by refining homogeneously the crystal grains, and the cost of equipment can be reduced.

Because material variance is expected to similarly exist for various working forms such as the bulging property besides the total elongation dealt with as the requirement of the present invention, it is believed that the effect of the present invention practically contributes to the improvements of a greater number of mechanical properties. On the other hand, though the present invention basically relates to a method of producing a material corresponding to a hot-rolled sheet from a thin cast strip, the steel sheet produced by the present invention can become a cold-rolled blank, too, in view of the fact that existing cold-rolled steel sheets and their plated steel sheets are produced by using a hot-rolled steel sheet as the blank.

We claim:

1. A twin-roll continuous casting method comprising:

pouring a molten metal of carbon steel having a carbon content of 0.0005 to 1 wt % between a pair of water cooled casting rolls, thereby providing a solidified casting;

regulating temperature of said solidified casting to a temperature range in which an austenite structure exists in the solidified casting matrix;

feeding the solidified casting in an inert gas atmosphere into an in-line rolling mill;

rolling the solidified casting in the in-line rolling mill to a predetermined thickness, said rolling being a one pass rolling with a reduction of 5 to 50% to provide a rolled steel sheet, said rolled steel sheet being an equivalent of a hot rolled steel sheet and having a surface roughness not greater than 20 $\mu$m;

taking up said rolled steel sheet by a coiler to provide a rolled steel sheet coil.

2. A twin-roll continuous casting method comprising:

pouring a molten metal of carbon steel having a carbon content of 0.0005 to 1 wt % between a pair of water cooled casting rolls, thereby providing a solidified casting;

providing an in-line rolling mill having an entry side downstream from an exit side of said pair of water cooled casting rolls;

transferring said solidified casting from the exit side of said pair of water cooled casting rolls to the entry side of said in-line rolling mill in an inert gas atmosphere;

regulating temperature of said solidified casting to a temperature range in which an austenite structure exists in the matrix of the solidified casting upon said solidified casting reaching the entry side of said in-line rolling mill;

rolling the solidified casting in the in-line rolling mill to a predetermined thickness, said rolling being a one pass rolling with a reduction of 5 to 50% to provide a rolled steel sheet, said rolled steel sheet being an equivalent of a hot rolled steel sheet and having a surface roughness not greater than 20 $\mu$m;

taking up said rolled steel sheet by a coiler to provide a rolled steel sheet coil.

3. A twin-roll continuous casting method according to claim 2 comprising providing said inert gas atmosphere from a kiss point between said pair of water cooled casting rolls to the entry side of said in-line rolling mill.

4. A twin-roll continuous casting method according to claim 2 wherein said temperature regulating comprises regulating temperature of said solidified casting in a range of 850° C. to 1,350° C. to provide said austenite structure.

5. A twin-roll continuous casting method according to claim 4 wherein said temperature range is 900° C. to 1,250° C.

6. A twin-roll continuous casting method according to claim 2 wherein said inert gas atmosphere has an oxygen concentration of not greater than 5%.

7. A twin-roll continuous casting method according to claim 2 wherein said inert gas atmosphere has an oxygen concentration of not greater than 2%.

* * * * *